US009214292B2

(12) United States Patent
Bramhapurikar et al.

(10) Patent No.: US 9,214,292 B2
(45) Date of Patent: Dec. 15, 2015

(54) COMPACT VACUUM INTERRUPTER WITH SELECTIVE ENCAPSULATION

(71) Applicant: ABB Technology Ltd, Zürich (CH)

(72) Inventors: Hrishikesh S. Bramhapurikar, Nagar (IN); Dukkaiappan Subbiahthever, Mahatmanagar (IN); Shashikant R. Ahire, Ambad (IN); Sanjay Khandalkar, Auran abad (IN); Venkatesan Prabaharan, Tamilnadu (IN); Ramesh Viswanathan, Rajiv Nagar Township (IN); Yogesh B. Hingane, Ahmednagar Dist (IN)

(73) Assignee: ABB TECHNOLOGY LTD, Zürich (CH)

( * ) Notice: Subject to any disclaimer, the term of this patent is extended or adjusted under 35 U.S.C. 154(b) by 249 days.

(21) Appl. No.: 13/854,624

(22) Filed: Apr. 1, 2013

(65) Prior Publication Data

US 2013/0213938 A1 Aug. 22, 2013

Related U.S. Application Data

(63) Continuation of application No. PCT/IB2010/003054, filed on Nov. 30, 2010.

(30) Foreign Application Priority Data

Oct. 1, 2010 (IN) ..... 2914/CHE/2010

(51) Int. Cl.
*H01H 33/662* (2006.01)
*H01H 1/66* (2006.01)

(52) U.S. Cl.
CPC ..... *H01H 1/66* (2013.01); *H01H 33/66207* (2013.01); *H01H 2033/6623* (2013.01); *H01H 2033/66276* (2013.01)

(58) Field of Classification Search
CPC H01H 33/66; H01H 33/662; H01H 33/66207
USPC ..... 218/118, 134–139
See application file for complete search history.

(56) References Cited

U.S. PATENT DOCUMENTS 7,820,934 B2 * 10/2010 Cardoletti et al. ..... 218/136
7,880,111 B2 * 2/2011 Inoue et al. ..... 218/136

FOREIGN PATENT DOCUMENTS

DE 93 14 754 U1 3/1994
JP 01041133 A * 2/1989 ..... H01H 33/66
WO WO 2010/015604 A1 2/2010

OTHER PUBLICATIONS

International Search Report (PCT/ISA/210) issued on Jun. 15, 2011, by the European Patent Office as the International Searching Authority for International Application No. PCT/IB2010/003054.

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A vacuum interrupter is disclosed with a fixed contact and a movable contact placed axially in a spaced apart relationship. The ceramic insulator cylinders each surround the fixed contact and the movable contact. A floating shield within the ceramic cylinders has a floating potential flange disposed between the two ceramic cylinders, and exposed to external ambient. Encapsulation for at least one contact terminal extends from a metallic end cap of the corresponding contacts to cover a respective ceramic cylinder by an overlapping distance.

14 Claims, 3 Drawing Sheets

COMPACT VACUUM INTERRUPTER WITH SELECTIVE ENCAPSULATION

RELATED APPLICATION

This application claims priority as a continuation application under 35 U.S.C. §120 to PCT/IP/2010/003054, which was filed as an International Application on Nov. 30, 2010 designating the U.S., and which claims priority to Indian Application No. 2914/CHE/2010 filed in India on Oct. 1, 2010. The entire contents of these applications are hereby incorporated by reference in their entireties.

FIELD

The present disclosure relates to a current interrupting device in an electrical distribution system, such as a compact vacuum interrupter for medium voltage application.

BACKGROUND

Vacuum interrupters are used for reliable interruption of fault current and load breaking in the electrical distribution systems. Vacuum interrupters have gained importance as compared with air, oil or SF6 filled current interrupting devices because of their reliability and compactness. The vacuum interrupters can be encapsulated for improved performance, compactness and better dielectric withstandability. Encapsulation of the vacuum interrupter herein refers to casting or potting of the vacuum interrupter with the encapsulating material such as silicone rubber.

Vacuum interrupters are embedded in epoxy resin to form poles of indoor circuit breakers. However, for outdoor circuit breakers, vacuum interrupters are assembled in porcelain or ceramic housings. The external dielectric creepage specification of a vacuum interrupter is overcome by encapsulating a layer of insulating material over the entire vacuum interrupter. Encapsulation can be done in a manner by which the metallic parts which are either at high potential or floating potential or earth potential are masked. Bonding agents can be used between the ceramic and the insulating material for proper adhesion.

Vacuum interrupters can be encapsulated to achieve advantages that are derived from increasing the creepage distance and clearance, and from decreasing high stress zones and non uniform stress zones. These are some of the exemplary considerations that are accounted for when encapsulating vacuum interrupters. However, in current practice with an attempt to achieve the above, the entire vacuum interrupter is encapsulated, by which the weight of the vacuum interrupter increases and by which an increase in the cost can occur along with other aspects that are encountered during the process of encapsulation. Moreover, the electric field intensity can increase, due to which the stress region is continuous from the pole top terminal to the bottom of the ceramic housing of the vacuum interrupter. This continuous stress region which is on the internal surface of the porcelain/ceramic housing of the outdoor vacuum circuit breaker can cause surface dielectric failure.

Owing to the above, exemplary embodiments disclosed herein are directed to encapsulation of the vacuum interrupter through a better design, and to providing a solution for encapsulating the vacuum interrupter and to catering to advantages of such encapsulation.

SUMMARY

A vacuum interrupter is disclosed comprising: a fixed contact and a movable contact placed axially in a spaced apart relationship; two ceramic insulator cylinders, surrounding the fixed contact and the movable contact, respectively; a floating shield located within the ceramic cylinders and having a floating potential flange disposed between the two ceramic cylinders and being exposed to an external ambient environment, or ambiance; and encapsulating material for encapsulating at least one contact terminal, and extending from a metallic end cap of the contact and covering the respective ceramic cylinder by an overlapping distance.

A method is also disclosed of improving voltage withstandability of a vacuum interrupter, having a fixed contact and a movable contact placed axially in a spaced apart relationship; two ceramic insulator cylinders, surrounding the fixed contact and the movable contact, respectively; a floating shield located within the ceramic cylinders and having a floating potential flange disposed between the two ceramic cylinders and being exposed to external ambient; and encapsulating material for encapsulating at least one contact terminal, and extending from a metallic end cap of the contact and covering the respective ceramic cylinder by an overlapping distance; the method comprising: encapsulating the vacuum interrupter with the encapsulating material by encapsulating the at least one contact terminal from the metallic end cap of the contact and covering the respective ceramic cylinder by an overlapping distance; and retaining a portion of the vacuum interrupter, having the floating potential flange exposed to external ambient, free of the encapsulating material.

BRIEF DESCRIPTION OF THE DRAWINGS

Exemplary embodiments will be described with reference to the accompanying drawings in which.

DETAILED DESCRIPTION

A vacuum interrupter is disclosed herein which can be arranged to optimize compactness relative to known arrangements.

In addition, a vacuum interrupter is disclosed which has exemplary merits of having higher creepage and clearance distance over a bare vacuum interrupter, and lesser high stress zones and non-uniform stress zones relative to a completely covered vacuum interrupter.

A vacuum interrupter as disclosed herein can also be capable of being upgraded to higher voltage capacity rating.

An exemplary vacuum interrupter as disclosed herein includes a fixed contact and a movable contact. The fixed and movable contacts are placed axially in a spaced apart relationship. The bare vacuum interrupter also includes two ceramic insulator cylinders. Each ceramic cylinder surrounds the fixed contact and the movable contact. A floating shield can be located within the ceramic cylinders. The floating shield can have a floating potential flange disposed between the two ceramic cylinders and is exposed to external ambient. The external ambient is under controlled pressure or atmospheric pressure.

The vacuum interrupter can be enclosed within a housing. The housing is, for example, suitably filled with air or oil or gas. Also, encapsulation is provided for the vacuum interrupter with an encapsulating material. The encapsulation can include encapsulation that is provided for at least one contact terminal extending from the metallic end cap of the corresponding contacts and covering the respective ceramic cylinder by an overlapping distance. Such encapsulation covering the ceramic cylinder by an overlapping distance and exposing the floating potential flange to the external ambience is called selective encapsulation. The encapsulating material can be a solid insulation such as silicone rubber. The overlapping distance mentioned herein is, for example, about or around (e.g., ±10%) 12 to 18 mm. The portion where a floating potential flange has been exposed can be free of encapsulation. The vacuum interrupter can be used, for example, for different voltage ratings (e.g., up to 40.5 kV or greater) through suitable modification. The vacuum interrupter provides a capability of being upgraded to higher capacity rating.

A method is also disclosed for improving voltage withstandability of a vacuum interrupter over a bare and fully encapsulated vacuum interrupter, in accordance with exemplary vacuum interrupters disclosed herein. An exemplary method can include: a) encapsulating the vacuum interrupter, wherein the encapsulating of the vacuum interrupter can include encapsulating at least one contact terminal from the metallic end cap of a corresponding contact and covering the respective ceramic cylinder by an overlapping distance; and b) exposing a portion having the floating potential flange to an external ambient environment (ambience), free from encapsulation.

Figure 1:
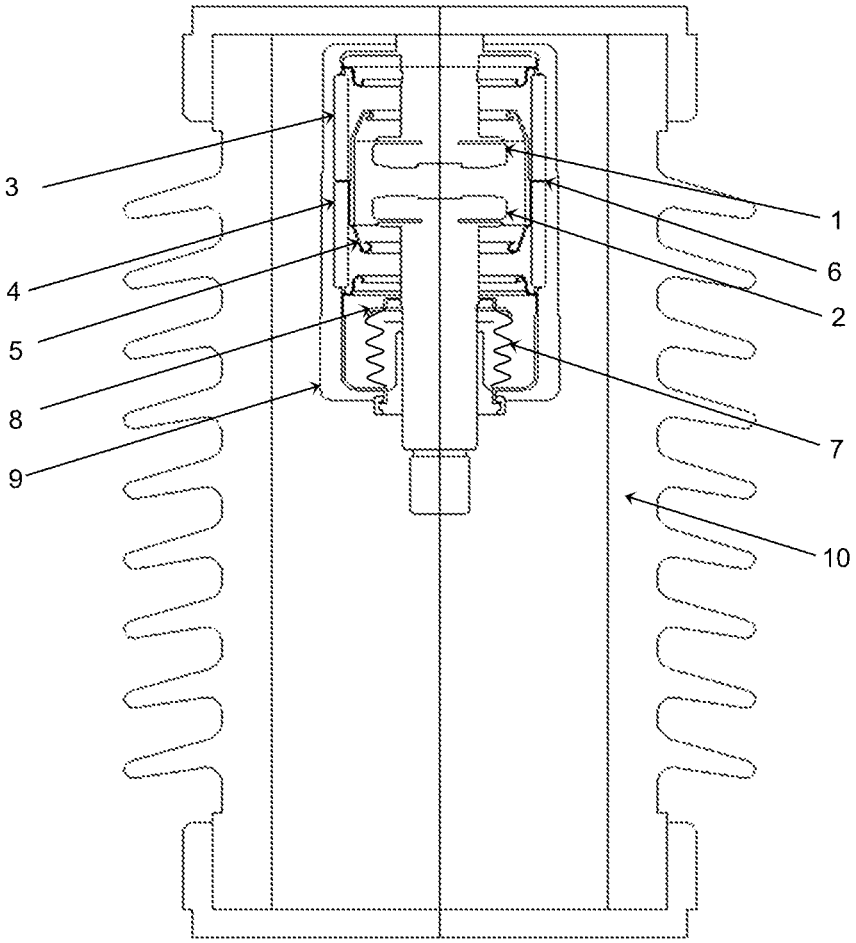
FIG. 1 shows a vertical cross sectional view of a known vacuum interrupter within a housing.

Referring to FIG. 1, a vacuum interrupter has a fixed contact (1) and a movable contact (2). The fixed and movable contacts are inside their corresponding ceramic cylinders (3, 4), respectively for the purpose of isolation.

There is a floating shield (5) having floating potential flange (6) which is not directly connected to either high voltage potential or earth potential. The floating potential flange (6) is disposed between two ceramic cylinders (3, 4), may be (e.g., equidistantly), in which case it is at a potential closer to half of the high voltage potential. This potential is called a floating potential.

The bellows (7) are provided for facilitating movement of the movable contact (2) of the vacuum interrupter and still retaining the vacuum inside the interrupter. There is a bellows shield (8) disposed above the bellows.

The entire set up of the vacuum interrupter is encapsulated with a suitable encapsulating material which can be a solid insulation, such as silicone rubber. This encapsulation (9) can mask the metallic parts which are at high potential or floating potential or earth potential. The encapsulating material can be bonded to the surface of the ceramic cylinders by a bonding agent for proper adhesion of the encapsulating material to the ceramic surface. The encapsulated vacuum interrupter is placed inside a porcelain housing (10) of the vacuum circuit breaker. The housing (10) can enclose air or oil or gas which is under controlled pressure or atmospheric pressure.

This kind of vacuum interrupter set up is suitable for porcelain clad outdoor circuit breakers. The external dielectric creepage limitations can be overcome through the encapsulation described herein.

However, in the vacuum interrupter the electrostatic field can become enhanced because of the encapsulating material covering the entire ceramic surface. The stress region is continuous from the pole of the top terminal to the bottom of the porcelain housing. This continuous stress region lies on the internal surface of the porcelain. Owing to the continuous stress region there is a chance of surface dielectric failure occurring due to acceleration of ionization in the cavity between the porcelain housing and the vacuum interrupter during service.

Considering the above, a vacuum interrupter is disclosed with lesser high stress zones, while avoiding non-uniform stress zones and adding more creepage and clearance distance. A specific design of the vacuum interrupter is provided that can cater for the merits of having lesser high stress zones and non-uniform stress zones, and that can be associated with more creepage and clearance distance. Besides this, a vacuum interrupter as disclosed herein can have lesser weight with increased performance, and that can be made available at a comparatively lower cost. Also, exemplary embodiments can accommodate for upgrading the voltage rating of the vacuum interrupter through suitable modification as appropriate and applicable.

Figure 2:
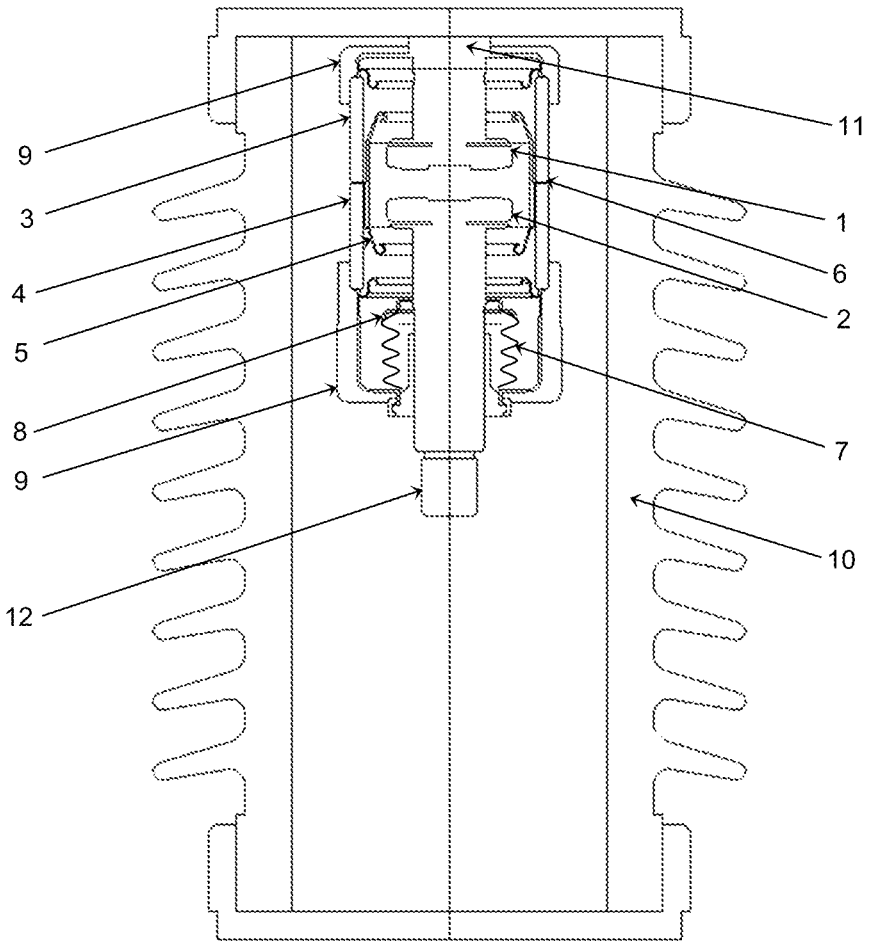
FIG. 2 shows a vertical cross sectional view of an exemplary vacuum interrupter within a housing as disclosed herein.
Figure 3:
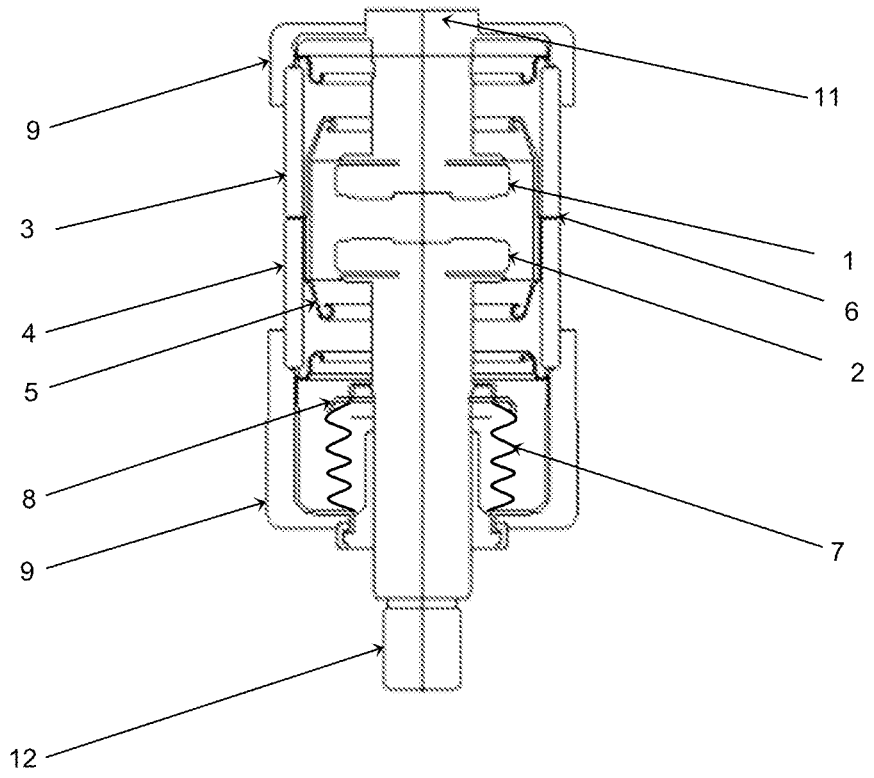
FIG. 3 shows the vertical sectional view of the vacuum interrupter of FIG. 2.

With reference to exemplary embodiments shown in FIGS. 2 and 3, encapsulation (9) is not provided for the entire vacuum interrupter. The encapsulation (9) of the at least one contact terminal (11, 12) with the encapsulating material is from the metallic end caps pertaining to the corresponding fixed and/or movable contact to a distance that overlaps the surface of the ceramic cylinder. The distance of overlap here can, for example, be about or around (e.g., ±10%) 12 to 18 mm depending upon the amount of upgradation desired, and can provide an arrangement that can be optizimed for compactness to known arrangements (e.g., that of FIG. 1).

It is noted that the floating potential flange (6) can be exposed to the external ambient which is under controlled or atmospheric pressure, and could be air or oil or gas enclosed within the porcelain housing (10), in a manner similar to as when complete encapsulation is provided. Here, the portion of the vacuum interrupter having the floating potential flange (6) can be retained exposed and is not encapsulated, and the area of non encapsulation is increased to the extent that only the exemplary 12-18 mm overlap is kept over ceramic insulators, thereby exposing it to the external ambient environment. The longer the ceramic area, the more the encapsulation is a free area. This can effectively reduce the high stress zones and non-uniform stress zones on the internal surface of the porcelain housing (10). Moreover, the stress region exhibited is not continuous which can eliminate the surface dielectric failure in the vicinity of the vacuum interrupter outer diameter and the porcelain inside diameter.

The voltage rating of the vacuum interrupter can be increased up to, for example 40.5 kV or greater, showing great flexibility for upgrading the voltage rating of the vacuum interrupter by selective encapsulation, which otherwise is not possible in existing vacuum interrupters.

Also, the weight of the vacuum interrupter can be reduced because a portion is devoid of encapsulation. The defects associated with encapsulation can be reduced. The cost can thereby become comparatively low.

Some aspects of the invention are not specifically described, yet will be well understood by a person skilled in the art. For example, certain other modifications or variations are construed to be within the scope of the invention.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

We claim:

1. A vacuum interrupter comprising:

a fixed contact and a movable contact placed axially in a spaced apart relationship;

two ceramic insulator cylinders, surrounding the fixed contact and the movable contact, respectively;

an encapsulation provided for the said vacuum interrupter with an encapsulating material, and includes encapsulation for at least one contact terminal extending from the metallic end cap of the corresponding said contacts and covering the respective said ceramic cylinder by an overlapping distance; and a floating shield located within the ceramic cylinders and having a floating potential flange disposed between the two ceramic cylinders and being exposed to external ambient, wherein the portion in which floating potential flange disposed between the two said ceramic cylinders being exposed is free of encapsulation for reduced stress on internal surface of a porcelain housing.

2. The vacuum interrupter as claimed in claim 1, wherein the encapsulating material is a solid insulation.

3. The vacuum interrupter as claimed in claim 1, wherein the overlapping distance is about 12 to 18 mm.

4. The vacuum interrupter as claimed in claim 1, comprising:

a housing, wherein the vacuum interrupter is enclosed within the housing which is filled with air or oil or gas.

5. The vacuum interrupter as claimed in claim 1, wherein the external ambient is under controlled pressure or atmospheric pressure.

6. The vacuum interrupter as claimed in claim 1, wherein the voltage rating of the vacuum interrupter is up to 40.5 kV.

7. The vacuum interrupter as claimed in claim 1, wherein a portion of the vacuum interrupter containing the floating potential flange is free of encapsulation material.

8. The vacuum interrupter as claimed in claim 1, comprising the fixed and movable contact, the two ceramic insulators, the floating shield and the encapsulation material in an arrangement optimized for compactness.

9. A method of improving voltage withstandability of a vacuum interrupter, having a fixed contact and a movable contact placed axially in a spaced apart relationship; two ceramic insulator cylinders, surrounding the fixed contact and the movable contact, respectively; a floating shield located within the ceramic cylinders and having a floating potential flange disposed between the two ceramic cylinders and being exposed to external ambient; and encapsulating material for encapsulating at least one contact terminal, and extending from a metallic end cap of the contact and covering the respective ceramic cylinder by an overlapping distance; the method comprising:

encapsulating the vacuum interrupter with the encapsulating material by encapsulating the at least one contact terminal extending from the metallic end cap of the corresponding contact and covering the respective ceramic cylinder by an overlapping distance; and retaining a portion of the vacuum interrupter, having the floating potential flange exposed to external ambient, free of the encapsulating material.

10. The method as claimed in claim 8, wherein the encapsulating comprises:

bonding the encapsulating material to a surface of the ceramic cylinders by a bonding agent for proper adhesion of the encapsulating material thereto.

11. The vacuum interrupter as claimed in claim 1, wherein the encapsulating material is a silicone rubber.

12. The vacuum interrupter as claimed in claim 4, wherein the external ambient is under controlled pressure or atmospheric pressure.

13. The vacuum interrupter as claimed in claim 12, wherein the voltage rating of the vacuum interrupter is up to 40.5 kV.

14. The vacuum interrupter as claimed in claim 13, wherein a portion of the vacuum interrupter containing the floating potential flange is free of encapsulation material.

* * * * *